US006765537B1

(12) United States Patent
Apostolos

(10) Patent No.: US 6,765,537 B1
(45) Date of Patent: Jul. 20, 2004

(54) DUAL UNCOUPLED MODE BOX ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/119,133

(22) Filed: Apr. 9, 2002

Related U.S. Application Data

(60) Provisional application No. 60/282,527, filed on Apr. 9, 2001.

(51) Int. Cl.[7] ..... H01Q 1/24
(52) U.S. Cl. ..... 343/741; 343/742; 343/846
(58) Field of Search ..... 343/702, 741, 343/742, 846, 700 MS, 780, 789

(56) References Cited

U.S. PATENT DOCUMENTS 5,784,032 A * 7/1998 Johnston et al. ..... 343/702
6,100,849 A * 8/2000 Tsubaki et al. ..... 343/702

* cited by examiner

*Primary Examiner*—James Clinger
(74) *Attorney, Agent, or Firm*—Daniel J. Long

(57) ABSTRACT

A dual uncoupled mode box antenna which includes a conductive bottom horizontal ground plane, and a box structure superimposed on this ground plane. The box structure includes a vertical first conductive side insulated from the ground plane, and a vertical second conductive side insulated from the ground plane positioned in gapped relation to the first side. There is also a vertical third conductive side which is grounded to the ground plane and which is positioned in perpendicular gapped relation to second side. A vertical fourth conductive side is also grounded to the ground plane and is positioned in perpendicular gapped relation to the first and third sides. A conductive top is superimposed over and insulated from the first, second, third, and fourth sides. The first and second sides are fed in quadrature to create either left handed or right handed polarization.

10 Claims, 3 Drawing Sheets

DUAL UNCOUPLED MODE BOX ANTENNA

CROSS REFERENCE TO RELATED APPLICATIONS

This application claims priority under U.S. Provisional Patent Application Serial No. 60/282,527 filed Apr. 9, 2001.

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION

1. Field of the Invention

The present invention relates to antennas and more particularly to box antennas.

2. Brief Description of Prior Developments

The prior art describes various types of box antennas. U.S. Pat. No. 6,034,644 to Okabe et al, for example, discloses a coaxial resonant slot antenna which includes a flat rectangular conductive box hanging its top plate with a slot being defined therein. A strip conductor is disposed inside the box and electrically insulated from the box while high frequency or RF power is fed to the strip. An island conductor is provided in the slot for defining a capacitance between itself and the frame. This capacitance is rendered variable in value by use of a variable circuit.

U.S. Pat. No. 6,307,520 to Liu discloses a boxed-in slot antenna which is provided with a conductive box, functioning as a waveguide, which is configured substantially parallel to the ground plane in which the slot is formed, thereby providing significant space savings relative to prior art designs wherein the box is positioned perpendicular to the conductive ground plane. The antenna is constructed using printed circuit board technology, by forming the ground plane as a coating on one side of a printed circuit board substrate, forming the main conductive plane of the conductive box structure on the other side of the printed circuit board, and interconnecting the two using plated through holes. The folded structure of the conductive box is reported to be suited for space-critical applications, such as may be found in laptop computers and other portable and handheld electronic devices, when it is desired to interconnect with a wireless local area network.

A need still exists, however, for a further improved box antenna which simultaneously allows for circular polarization in an inexpensive, compact, and broad band configuration.

SUMMARY OF INVENTION

The present invention is a dual uncoupled mode box antenna which includes a conductive bottom horizontal ground plane. In this antenna there is a box structure superimposed on this ground plane. The box structure includes a vertical first conductive side insulated from the ground plane, and a vertical second conductive side insulated from the ground plane positioned in gapped relation to the first side. There is also a vertical third conductive side which is grounded to the ground plane and which is positioned in perpendicular gapped relation to the second side. A vertical fourth conductive side is also grounded to the ground plane and is positioned in perpendicular gapped relation to the first and third sides. A conductive top is superimposed over and insulated from the first, second, third, and fourth sides. The first and second sides are fed in quadrature to create either left handed or right handed polarization.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
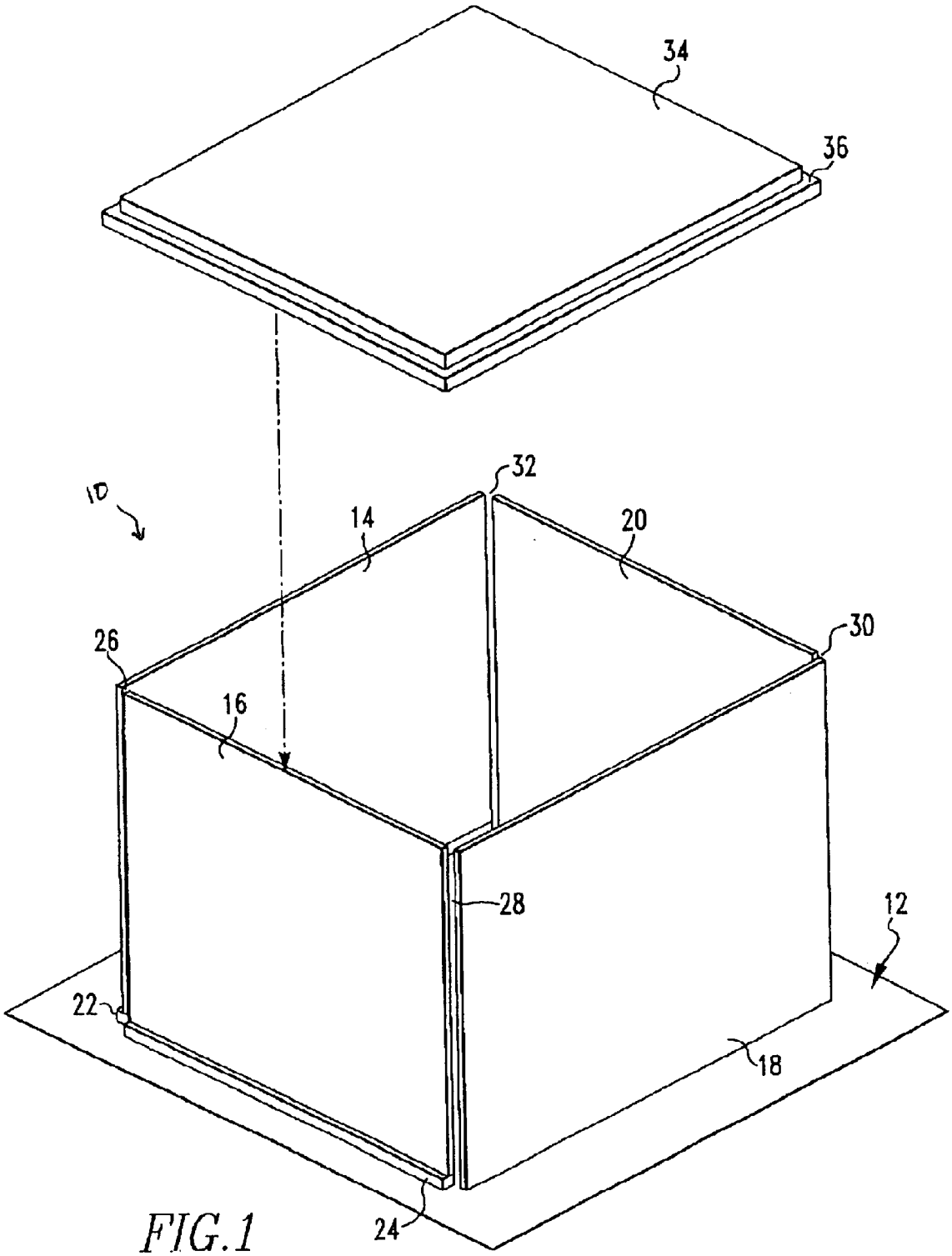
FIG. 1 is a perspective view of a preferred embodiment of the antenna of the present invention in which the cover is shown suspended above the other antenna elements for the purposes of clarity.
Figure 3:
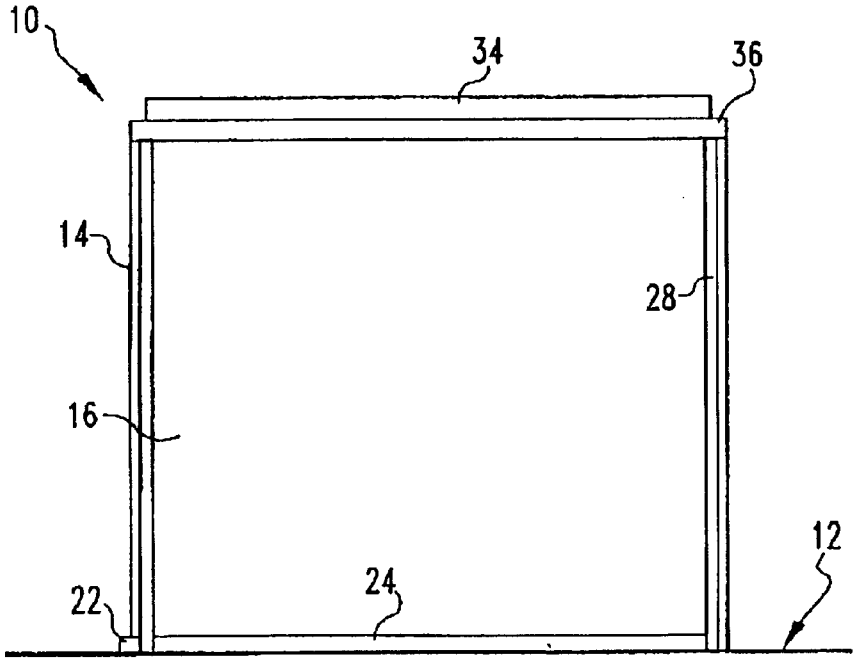
FIG. 3 is a side elevational view of the antenna shown in FIG. 1.
Figure 4:
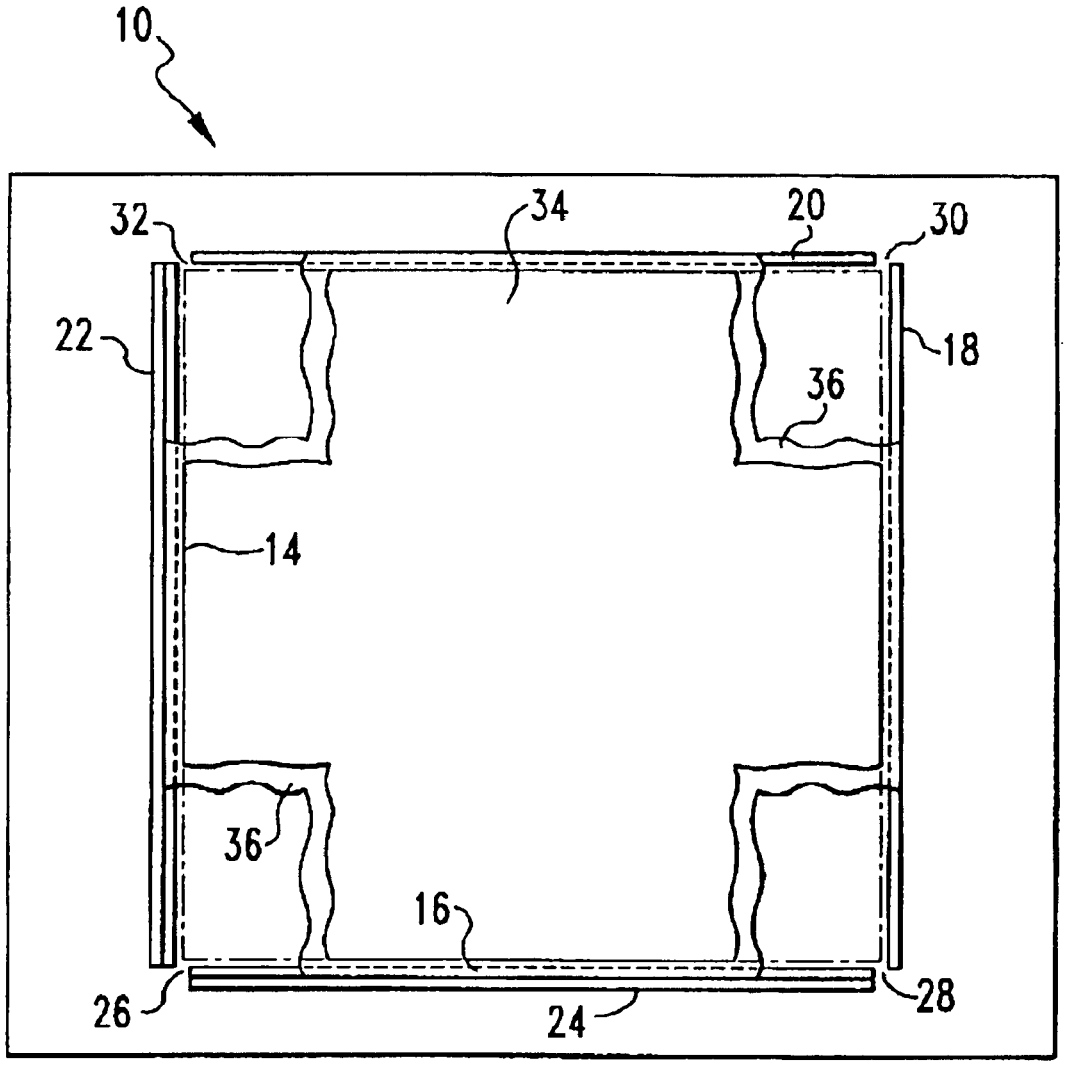
FIG. 4 is a cut away top plan view of the antenna shown in FIG. 1.

Referring to FIGS. 1, 3 and 4, the antenna 10 is mounted on a bottom conductive ground plate 12. Conductive sides 14 and 16 extend upwardly from the ground plane and are mounted perpendicularly with respect to each other. Conductive sides 18 and 20 also extend up from the ground plane and are mounted in spaced parallel relation respectively to sides 14 and 16 and perpendicularly with respect to each other. Between the ground plane 12 and side 14 there is a insulation footer strip 22. Between the ground plane 12 and side 16 there is another dielectric insulation footer strip 24. There is an air gap 26 between side 14 and side 16. Another air gap 28 is between side 16 and side 18. Another air gap 30 is between side 18 and side 20, and another air gap 32 is between side 20 and side 14. These sides are conductive metal plates, and a top 34 which is also a conductive metal plate is superimposed over the sides 14, 16, 18 and 20. There is an insulating dielectric layer 36 between the top 34 and the sides 14, 16, 18 and 20.

Figure 2:
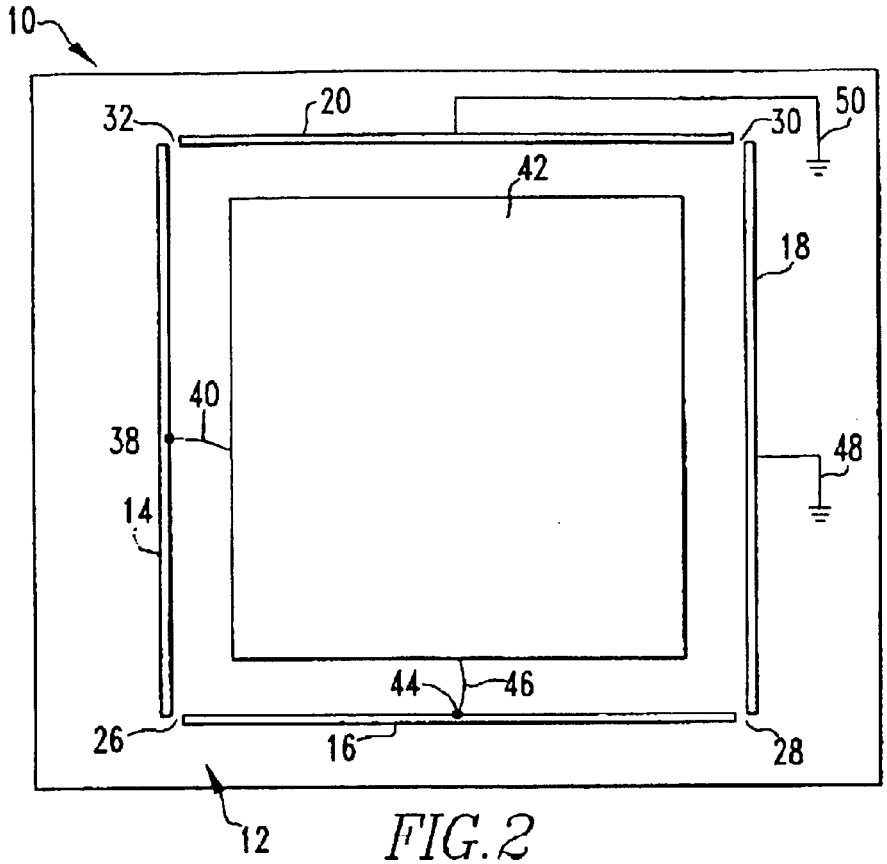
FIG. 2 is a schematic diagram of the antenna shown in FIG. 1.

Referring to FIG. 2, it will be seen that side 14 is connected from coupling point 38 through connection 40 to quadrature hybrid circuit 42. Side 16 is connected from coupling point 44 to connection 46 to quadrature hybrid circuit 42. Sides 14 and 16 are used as radiating elements and are fed their respective signals from quadrature hybrid circuit 42 at coupling points 38 and 44 respectively. Side 18 is grounded at connection 48 to the ground plane 12. Side 20 is grounded to the ground plane at connection 50. Although the ground connection for the sides 18 and 20 is shown as a specific connection, it will be understood that sides 18 and 20 are typically connected to the ground plane 12 along their entire bottom edges.

As is also shown within the confines of the antenna 10 is the quadrature hybrid circuit 42 which is used to generate quadrature signals for feeding the insulated radiating elements at sides 14 and 16. The electrical feed for the hybrid circuit 42 is coupled through the ground plane 12. This location for the hybrid circuit does not interfere with antenna operation.

Referring again to FIGS. 3 and 4, it will be understood that these views of the antenna 10 with the top 34 is in its operative location. The top 34 is nominally mechanically mounted to the sides 14, 16, 18 and 20 through the insulating dielectric layer 36. Top 34 is thereby electrically insulated from the sides 14, 16, 18 and 20 except for parasitic coupling of electromagnetic signals.

The insulated radiating elements at sides 14 and 16 may be fed in quadrature to create either left handed or right handed polarization. The dimensions of the antenna 10 are set to approximately one-eighth of a wavelength at the desired frequency of operation. The "dimension" of the antenna would, for example, be considered to be the length of one of the sides or the top when the antenna 10 is in a cubical shape. Under excitation by an appropriate RF signal, current flow is established in two orthogonal circular patterns from each of the radiating elements 14 and 16 through the top 34 and into the opposing grounded sides 18 and 20, respectively. Signals passing through top 34 in orthogonal directions have approximately 20 db of separation in terms of cross coupling.

Test

A dual mode box antenna was made according to the above description in the shape of a 0.72 inch cube. This antenna was used to radiate an RF signal at a frequency of from 2.1–2.5 GHZ in an anacoustic laboratory with the results shown in Table 1.

TABLE 1

| Gain (DBIC) | VSWR | Freq. (GHZ) |
|---|---|---|
| 2 | 2.0 | 2.2 |
| 3.3 | 1.8 | 2.25 |
| 4.0 | 1.7 | 2.30 |
| 4.4 | 1.55 | 2.35 |
| 4.5 | 1.4 | 2.40 |
| 4.9 | 1.7 | 2.45 |
| 2 | 2.0 | 2.50 |

It will be appreciated that a box antenna has been described which is capable of circular polarization in an inexpensive, compact and broad band configuration.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A dual uncoupled mode box antenna comprising:

a conductive ground plane; and a box structure superimposed on said ground plane comprising:

a first conductive side and a second conductive side and said first and second conductive sides are both insulated from the conductive ground plane;

a third conductive side positioned in spaced opposed relation to the first conductive side and a fourth conductive side positioned in spaced opposed relation to the second conductive side and said third and fourth conductive sides are both grounded to said ground plane;

a conductive top superimposed over the first, second, third and fourth conductive side; and an air gap between said third conductive side and said fourth conductive side.

2. The box antenna of claim 1 wherein the conductive top is insulated from the first, second, third and fourth conductive sides.

3. The box antenna of claim 1 wherein there is a dielectric insulation between the conductive top and the first, second, third and fourth conductive sides.

4. The box antenna of claim 1 wherein there is an air gap between the first conductive side and the second conductive side.

5. The box antenna of claim 1 wherein there is a dielectric footer between the first conductive side and the ground plane, and there is a dielectric footer between the second conductive side and the ground plane.

6. The box antenna of claim 1 wherein there is an air gap between the first and fourth conductive sides and between the second and third conductive sides.

7. The box antenna of claim 1 wherein the first, second, third, and fourth conductive sides are perpendicular to the ground plane.

8. The box antenna of claim 1 wherein the first, second, third, and fourth conductive sides and the conductive top are metal plates.

9. The box antenna of claim 1 wherein a quadrature hybrid circuit is connected to the conductive side which is insulated from the conductive ground plane.

10. The box antenna of claim 1 which is used for a desired frequency having a wavelength wherein the first, second, third, and fourth conductive sides each have a dimension and said dimension is about one eighth of said wavelength.

* * * * *